United States Patent [19]

Du Corday

[11] 4,128,262

[45] Dec. 5, 1978

[54] MAGAZINE COVER

[76] Inventor: Gerard M. Du Corday, 10871 Thorley Rd., Santa Ana, Calif. 92705

[21] Appl. No.: 830,839

[22] Filed: Sep. 6, 1977

[51] Int. Cl.[2] ..... B42D 3/04

[52] U.S. Cl. ..... 281/34; 281/48

[58] Field of Search ..... 281/20, 34, 4, 17, 19, 281/46, 47, 48, 49, 50

[56] References Cited

U.S. PATENT DOCUMENTS

| | | | |
|---|---|---|---|
| 1,049,311 | 12/1912 | Minor | 281/47 |
| 1,253,435 | 1/1918 | Simpson | 281/48 |
| 2,082,423 | 6/1937 | Schade | 281/19 R |
| 2,355,037 | 8/1944 | Einzig | 281/46 |
| 3,572,767 | 3/1971 | Learned et al. | 281/34 |

FOREIGN PATENT DOCUMENTS

| | | | |
|---|---|---|---|
| 2011111 | 7/1971 | Fed. Rep. of Germany | 281/47 |
| 1007951 | 2/1952 | France | 281/47 |

*Primary Examiner*—Frank T. Yost

*Attorney, Agent, or Firm*—Gausewitz, Carr & Rothenberg

[57] ABSTRACT

A flexible and readily attachable and removable protector for saddle stitched magazines, books, and the like, is formed of an integral, flexible sheet of transparent plastic having a reinforced spine projecting from a central portion. The spine extends from top to bottom of the sheet and is formed with a slot extending for nearly its full length so that the cover sheet and half of the pages of a magazine may be inserted through the spine slot and the magazine cover sheet may be inserted in pockets formed in the protector.

12 Claims, 7 Drawing Figures

MAGAZINE COVER

BACKGROUND OF THE INVENTION

The present invention relates to covers for magazines, books, and the like, and more particularly concerns a protector of simple construction effectively and detachably connectable to a magazine or book and readily removable therefrom.

Magazines and books that are subject to use by transients, experience hard use that frequently damages or destroys the cover, the page contents, or both. Thus it is common in such transient or public areas such as, for example, the waiting room of a professional's office or a commercial airplane, to provide each of the magazines that are made available for use of patients, clients, customers, passengers, and the like, with a protective cover that protects the magazine but does not interfere with its use. Periodical publications, such as magazines, are replaced in such areas on a weekly or monthly basis. But common sense and economy dictate the reuse of the protective cover. Thus the protective covers must be regularly attached to and removed from the magazines.

Covers commonly used are complex and costly, heavy and bulky, and often difficult to remove from or attach to a magazine. For example, a commonly used cover employs a backbone having a rigid metallic bar that is detachable, at least at one end, so that a magazine may be inserted between the bar and the center portion of the cover to which it is connected. The detaching and re-connection of such connecting bar is relatively time-consuming, particularly when one realizes the large number of such magazines that are required to be changed. Moreover, such covers are costly and bulky and make magazine storage more difficult.

Accordingly, it is an object of the present invention to provide a cover that eliminates or minimizes abovementioned difficulties.

SUMMARY OF THE INVENTION

In carrying out principles of the present invention in accordance with a preferred embodiment thereof, a readily attachable and removable protector for magazines and books is formed of a sheet of flexible material having first and second end portions adapted to extend along outside surfaces of the cover of the magazine or book. The central portion of the sheet has a spine projecting from its surface and an elongated slot is formed in the spine extending substantially the full length of the spine. A magazine or book may be opened and one cover and several pages thereof inserted through the slot to position the spine between pages of the magazine or book with the protector sheet end portions extending about the magazine or book.

DETAILED DESCRIPTION

Figure 1:
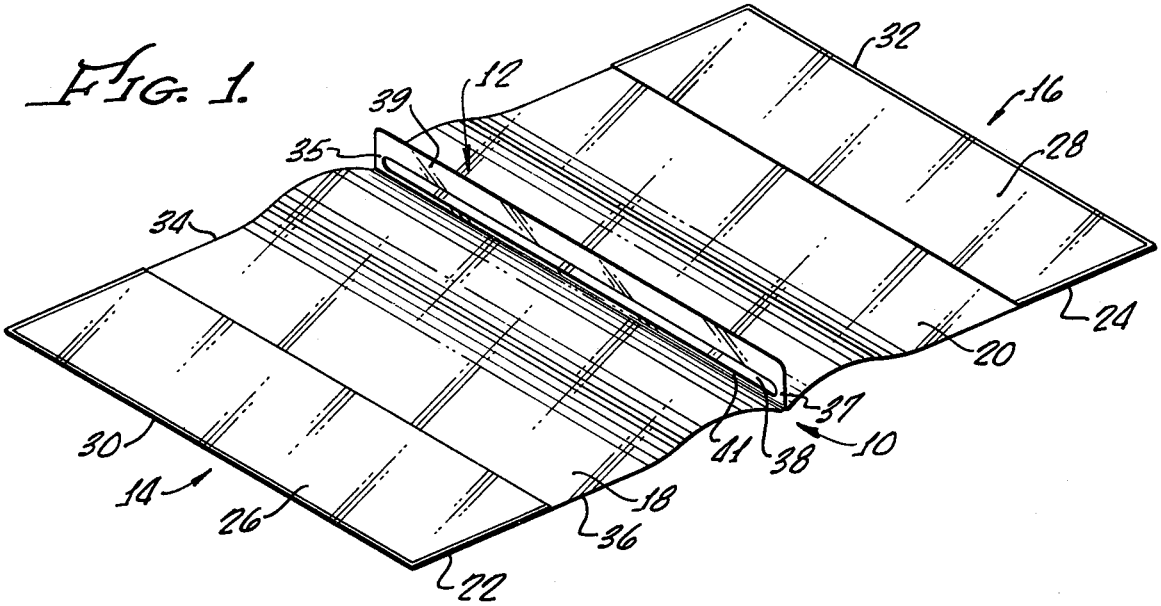
FIG. 1 is a perspective view of a protector embodying principles of the present invention.

As illustrated in FIG. 1, a magazine protector is formed of an integral sheet of flexible material generally indicated at 10, having fixed thereto a centrally positioned spine 12 and having end pockets 14, 16 for reception of a book or magazine. The protector sheet 10 comprises first and second body sections 18, 20 integral with each other and with the central portion to which the spine 12 is connected. The body sections 18 and 20 include end portions 22, 24, to which are secured pocket forming sheets 26 and 28. The assembly is generally of the rectangular configuration, having first and second end edges 30, 32 and top and bottom edges 34, 36.

Spine 12 is formed with a long, narrow slot 38 that extends nearly from top to bottom of the sheet 10, leaving only relatively narrow end strips 35, 37 connecting the outer area 39 of the spine to its inner area 41.

The described protector may be formed of many difference materials and in many processes. It is important that the material be thin, flexible and inexpensive, yet resistant to abrasion, wear, tearing, and puncture. It is also desirable that the material be transparent, whereby the identifying cover of the enclosed magazine may be readily visible through the body sections 18 and 20. In a presently preferred embodiment, the entire cover is made from a transparent 8 mil vinyl plastic sheet having a reinforcing strip for the spine (to be described below) that may be either of the same material or preferably of a material with a somewhat greater strength than the 8 mil transparent vinyl.

Figure 2:
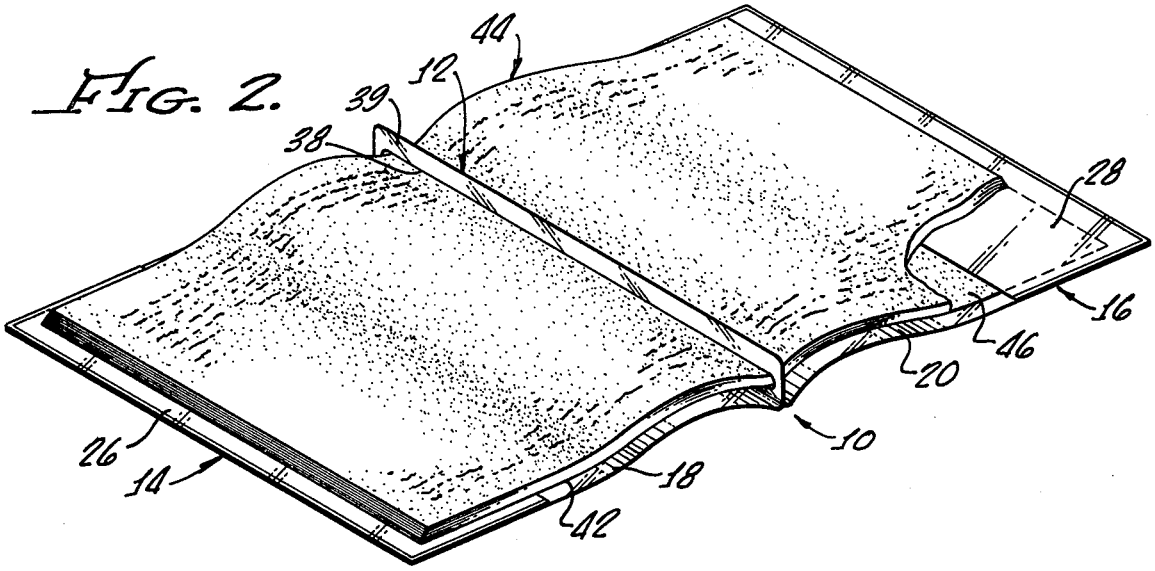
FIG. 2 illustrates a magazine in open position, with parts broken away, inserted into the protector of FIG. 1.
Figure 6:
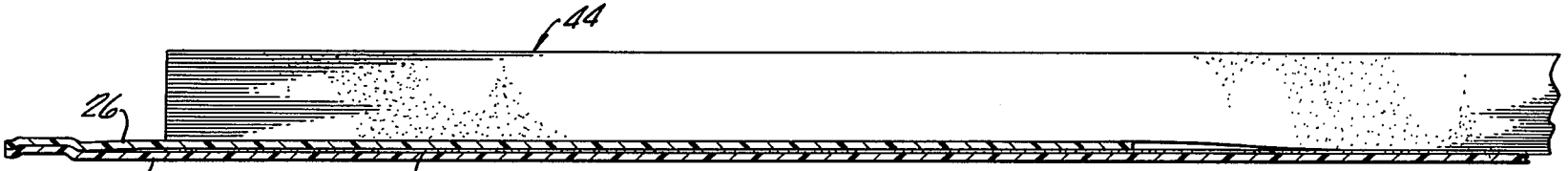
FIG. 6 is an end elevation, greatly enlarged, showing portions of a magazine having its cover inserted in the pocket formed on the end of the detachable protector.

The described protector is specifically adapted for use with "saddle stitched" magazines, those with no rigid bindings, but in which the pages are held together either by stitching or staples extending through the innermost double sheet and the outermost sheet or cover of the magazine. Such a saddle stitched magazine is attached to the described protector in the manner illustrated in FIGS. 2, 3 and 6. One outermost sheet, or cover of a magazine 44, together with a number of pages, preferably about half the pages, are inserted through the slot 38 in the spine 12. Then the magazine covers are inserted into the pockets 14 and 16 of the protector. The outermost sheet or cover 42 of the magazine is inserted into the pocket 14 of the protector and the other outermost sheet 46 of the magazine is inserted into the protector pocket 16, as can be seen by the dotted line showing of cover 46 under the portion of the broken away pages of the magazine 44 of FIG. 2.

Figure 3:
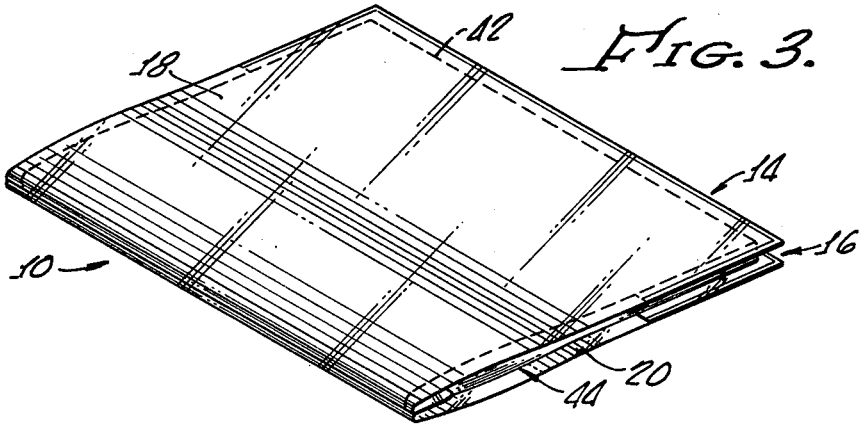
FIG. 3 illustrates the covered magazine of FIG. 2 in closed position.

The protector, being made of a thin flexible material, provides no obstruction to the normal use, handling and motions of the magazine. The latter, therefore, may be readily closed, as shown in FIG. 3, in which condition the spine 12, being flat and thin, readily lies between the magazine pages.

Figure 4:
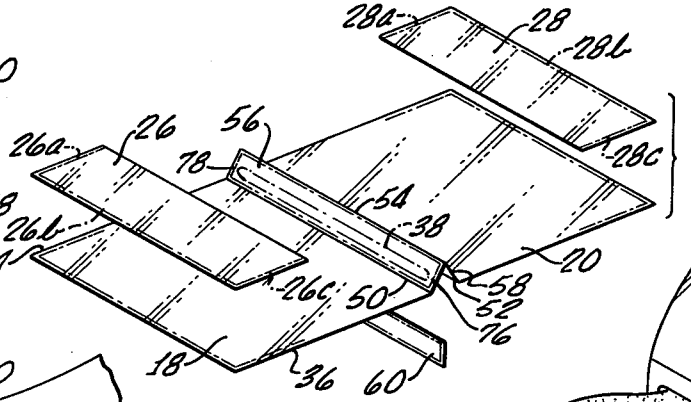
FIG. 4 is an exploded perspective view of protector parts prior to assembly.

A presently preferred method of construction of the described protector may be understood from inspection of the exploded view of FIG. 4. A single integral sheet of transparent plastic (although other thin flexible materials may be readily employed) is cut to the illustrated rectangular configuration and provided with a pair of mutually spaced outer score lines 50 and 52 and an intermediate score line of 54 that is spaced equally from both outer lines. The central portion of the integral sheet is encompassed between the outer score lines 50 and 52 and is folded down upon itself along line 54 to provide first and second spine sections 56, 58 that are integral with each other, connected along line 54, and which may be juxtaposed to each other in face-to-face contiguity. The respective spine sections 56 and 58 are connected to the respective body portions 18, 20 of the sheet along the outer fold lines 50 and 52. When the sheet has been partly folded along the indicated fold lines to a position somewhat similar to that illustrated in FIG. 4, a reinforcing strip 60 is inserted between the spine sections 56, 58, extending the full length of the spine and the full height of the integral sheet between top and bottom edges 34 and 36. The reinforcing strip 60 has a width preferably equal to the width of each of the spine sections and thus is coextensive with each of these, projecting up from the plane of the body portions 18 and 20 from outer fold lines 50 and 52 to the intermediate fold line 54.

Reinforcing strip 60 may be made of a material other than plastic or may be made of a less flexible material, including a more rigid plastic, wood or metal, or the like. The upper and lower ends 35, 37 of the spine and upper and lower ends of the slot are points that are likely to be subjected to the greatest amount of stress and such points may be still further reinforced if deemed necessary or desirable.

The two spine sections with the interposed reinforcing strip are then pressed together and secured to each other as by heat welding, or the like, to provide a laminated reinforced spine structure. Thereafter the slot 38 is cut in the laminated spine section and pocket sheets 26 and 28 are secured to the end portions of the integral sheet along heat weld lines **28*a*, 28*b* and 28*c* and lines 26*a*, 26*b* and 26*c***. The pocket sheets may be secured to the main sheet prior to the scoring or folding, or before other steps such as the formation of the laminated reinforced spine structure.

As previously noted, the reinforcing strip 60 may be made from the same material as the remainder of the protector, or it may be made from a material having greater strength to improve the reinforcement.

Figure 5:
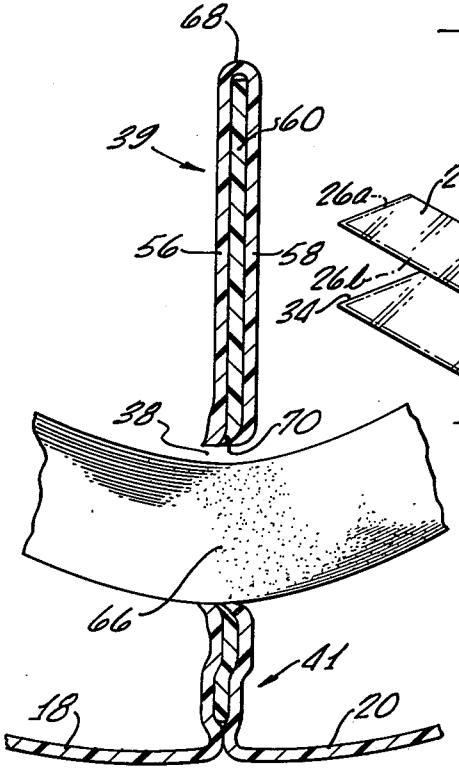
FIG. 5 is a sectional view, greatly enlarged, showing portions of the spine and magazine pages inserted therethrough.

As can be seen in the enlarged fragmentary sectional view of FIG. 5, the central portion 66 of the covered magazine may be a relatively close fit within the slot 38 of spine 12. It can be readily seen from inspection of FIG. 5, that the spine slot is positioned closer to the main body portions 18 and 20 than to the free projecting end 68 of the spine. Thus the spine portion 39 has a considerable extent in a direction normal to the spine length and normal to the plane of the open protector. This extent of the spine portion 39 between its free end 68 and its end 70, which defines the outer side of the slot 38, is much greater than the thickness of the spine from one of the spine sections to the other (e.g., the total of the three thicknesses of the spine laminations). Therefore the spine has a large degree of resistance to bending about an axis that is perpendicular to the plane of the spine (an axis perpendicular to the spine sections 56 and 58 as viewed in FIG. 5 and lying in the plane of the paper of this Figure).

It will be seen that even though the described protector is made of a relatively thin and flexible plastic, it will, in fact, provide a significant amount of center support which is normally needed for the ordinary saddle stitched magazine since the latter has no solid binding. The spine is a main feature of the protector construction that secures the protector to the magazine. Thus the protector with an attached magazine may be opened and held upside down with the magazine facing downwardly, but the spine will retain the magazine within the protector. Similarly the magazine secured to the described protector can be readily picked up and handled by holding solely one magazine cover (encased in the protector) and the protector will remain attached. The protector will offer resistance to wear and tear and mishandling of the magazine and will prevent the magazine cover from being torn or detached.

Figure 7:
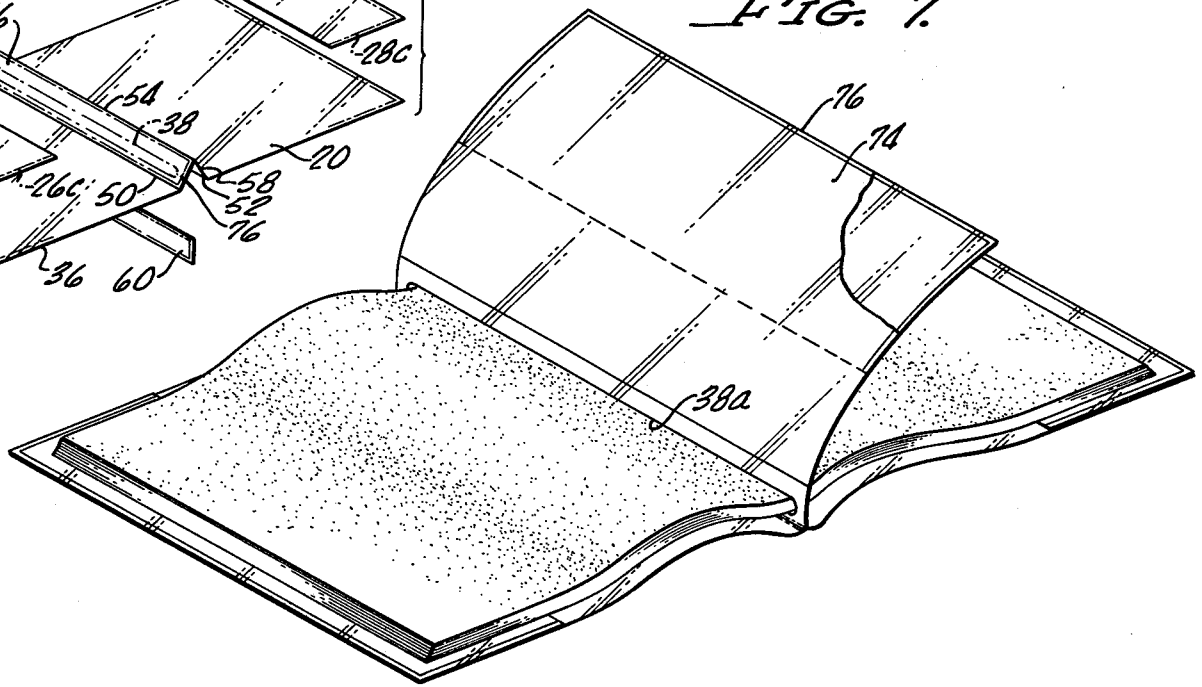
FIG. 7 illustrates a modification of the protector attached to an open book.

If deemed necessary or desirable, the reinforced spine may be extended, as illustrated in FIG. 7, to include a section 74 extending beyond the spine slot **38*a* considerably further than the extent of spine area 39. Extension 74 may have a dimension from its free end 76 to the spine slot substantially equal to or slightly less than the length of one of the protector body sections 18 or 20. The extension is preferably formed with a pocket capable of receiving and presenting to the reader an advertising or other type of display. The extension 74, of course, is of a transparent material and may have the two juxtaposed separate sections thereof formed as extensions of the spine sections 56 and 58, welded together along two edges, leaving the third edge, such as edge 76, for example, open for reception of display material. However, in both the embodiment of FIG. 7** and that illustrated in other figures, the spine sections are preferably welded to one another on both sides of the slot, at the slot edges, by means of a heat weld that extends continuously from the top to the bottom edge of the protector. The reinforcing strip for the spine extends from the sheet body to a point just short of the display pocket.

Although it is preferred at present to form the protector as described in connection with FIG. 4 of a single integral sheet (except for the strip 60 and sheets 26, 28), it will be readily appreciated that the protector may be formed of several different sheets connected to one another as by heat welding or the like, at suitable points. Thus, for example, one spine section 58 and one body section 20 may be formed of a single piece and the other body section 18 together with the other spine section 56 may be formed of a second integral piece and the two welded together on opposite sides of the slot that is formed or will thereafter be formed therein. Similarly, the pocket sheets 26 and 28 may be formed integrally with the body sections 18 and 20 and then folded over to form a pocket before welding along only the upper and lower edges, as would be necessary in such a construction. Other construction variations will be apparent to those skilled in the art.

There has been described a simple, inexpensive and effective protector for magazines and flexibly covered books and the like, made entirely of thin flexible material, requiring no movable or detachable rigid bars, rods, or strips, and which can be used with saddle stitched magazines or those bound by other means.

The foregoing detailed description is to be clearly understood as given by way of illustration and example only, the spirit and scope of this invention being limited solely by the appended claims.

What is claimed is:

1. A readily attachable and detachable protector for magazines, flexible cover books and the like comprising, (a) an integral sheet of flexible material having first and second integral end portions adapted to extend along the outside surfaces of the cover of a magazine, book or the like, and having a central portion connected to said integral sheet, said central portion comprising a spine fixed to and projecting from the surface of said sheet, said spine including first and second spine sections having inner surfaces in face-to-face juxtaposition and securely connected to each other, and an elongated slot formed in said spine sections extending for substantially the full length of said spine, whereby a magazine or book may be opened and one cover and several pages thereof may be inserted through said slot to position said spine between pages of said magazine or book with said sheet end portions extending about the magazine or book.

2. The detachable protector of claim 1 including means for detachably securing said end portions to respective covers of a magazine or book.

3. A readily attachable and detachable protector for magazines, flexible cover books and the like comprising, a sheet of flexible material having first and second end portions adapted to extend along the outside surfaces of the cover of a magazine, book or the like, and having a central portion, said central portion comprising a spine fixed to and projecting from the surface of said sheet, and an elongated slot formed in said spine extending for substantially the full length of said spine, whereby a magazine or book may be opened and one cover and several pages thereof may be inserted through said slot to position said spine between pages of said magazine or book with said sheet end portions extending about the magazine or book, said sheet including a main body portion that includes said central portion, said spine being formed integrally with said main body portion and comprising first and second spine sections connected to each other along a fold line therebetween, said fold line being positioned at an edge of said spine remote from said sheet, said spine sections being respectively connected to said sheet at first and second fold lines in said main body portion.

4. A readily attachable and detachable protector for magazines, flexible cover books and the like comprising, a sheet of flexible material having first and second end portions adapted to extend along the outside surfaces of the cover of a magazine, book or the like, and having a central portion, said central portion comprising a spine fixed to and projecting from the surface of said sheet, an elongated slot formed in said spine extending for substantially the full length of said spine, whereby a magazine or book may be opened and one cover and several pages thereof may be inserted through said slot to position said spine between pages of said magazine or book with said sheet end portions extending about the magazine or book, said sheet including first and second body sections at opposite sides of said central portion, said spine comprising first and second spine sections having inner surfaces in face-to-face juxtaposition, each spine section being connected to a respective one of said body sections, and each extending for substantially the full width of said sheet.

5. A readily attachable and detachable protector for magazines, flexible cover books and the like comprising, a sheet of flexible material having first and second end portions adapted to extend along the outside surfaces of the cover of a magazine, book or the like, and having a central portion, said central portion comprising a spine fixed to and projecting from the surface of said sheet, and an elongated slot formed in said spine extending for substantially the full length of said spine, whereby a magazine or book may be opened and one cover and several pages thereof may be inserted through said slot to position said spine between pages of said magazine or book with said sheet end portions extending about the magazine or book, said spine including at least three mutually coextensive and mutually contiguous spine sections secured to each other to provide a laminated spine structure having a relatively large resistance to bending about an axis perpendicular to the plane of such structure, at least one of said spine sections being secured along substantially the full length thereof to said sheet.

6. A readily attachable and detachable protector for magazines, flexible cover books and the like comprising, a sheet of flexible material having first and second end portions adapted to extend along the outside surfaces of the cover of a magazine, book or the like, and having a central portion, said central portion comprising a spine fixed to and projecting from the surface of said sheet, and an elongated slot formed in said spine extending for substantially the full length of said spine, whereby a magazine or book may be opened and one cover and several pages thereof may be inserted through said slot to position said spine between pages of said magazine or book with said sheet end portions extending about the magazine or book, said spine extending from said sheet for a distance equal to a major portion of the distance between said central portion and one of said end portions, said spine having a pocket therein for reception of a display sheet or the like.

7. The detachable protector of claim 6 wherein said spine includes first and second spine sections and a reinforcing strip therebetween, said reinforcing strip extending from about the junction of said spine and said sheet beyond said slot to a point short of said spine pocket.

8. A readily attachable and detachable protector for magazines, flexible cover books and the like comprising, a sheet of flexible material having first and second end portions adapted to extend along the outside surfaces of the cover of a magazine, book or the like, and having a central portion, said central portion comprising a spine fixed to and projecting from the surface of said sheet, and an elongated slot formed in said spine extending for substantially the full length of said spine, whereby a magazine or book may be opened and one cover and several pages thereof may be inserted through said slot to position said spine between pages of said magazine or book with said sheet end portions extending about the magazine or book, said sheet and said spine being formed of a single integral sheet bent about a first centrally positioned fold line to provide mutual juxtaposition of first and second spine sections connected to each other at said fold line, said sheet being bent about second and third fold lines to permit said end portions to be juxtaposed to one another with said spine sections interposed therebetween.

9. A readily attachable and detachable magazine protector comprising, a single integral flexible sheet having a central portion and first and second body sections extending from each side of said central portion, said sheet having first and second end edges and top and bottom edges, said central portion having a plurality of mutually spaced fold lines extending between said top and bottom edges, said body sections being folded relative to said central portion about outer ones of said fold lines, said central portion being folded upon itself about an intermediate one of said fold lines to provide first and second mutually contiguous spine sections, said first and second spine sections being secured to each other adjacent said outer fold lines, and a slot formed in said spine sections extending from a point adjacent said top edge to a point adjacent said bottom edge of said sheet.

10. The protector of claim 9 wherein said slot is positioned relatively closer to the junction of said spine sections with said body sections and relatively further from said intermediate fold line of said central portion.

11. The protector of claim 9 including an extension connected with said spine sections and having a transparent pocket formed therein for reception of a flat display sheet or the like.

12. The protector of claim 9 including magazine cover receiving pockets formed at ends of said body portions.

* * * * *